US011353287B1

(12) United States Patent
Norris

(10) Patent No.: US 11,353,287 B1
(45) Date of Patent: Jun. 7, 2022

(54) SYSTEMS AND METHODS FOR PROVIDING INFORMATION TO USERS OF HAND-HELD WEAPONRY

(71) Applicant: Wrap Technologies, Inc., Las Vegas, NV (US)

(72) Inventor: Elwood Norris, Poway, CA (US)

(73) Assignee: Wrap Technologies, Inc., Tempe, AZ (US)

( * ) Notice: Subject to any disclaimer, the term of this patent is extended or adjusted under 35 U.S.C. 154(b) by 158 days.

(21) Appl. No.: 16/875,392

(22) Filed: May 15, 2020

Related U.S. Application Data

(60) Provisional application No. 62/848,813, filed on May 16, 2019.

(51) Int. Cl.
*F41G 1/35* (2006.01)
*F41A 17/06* (2006.01)

(52) U.S. Cl.
CPC ..... *F41G 1/35* (2013.01); *F41A 17/06* (2013.01)

(58) Field of Classification Search
CPC ..... F41G 1/35; F41G 1/46; F41G 13/0025; F41H 13/00; F41H 13/0006; F42B 12/56; F42B 12/66; F42B 7/04; F41B 11/80; F41B 15/00; F41B 15/10; F41A 21/32
USPC ..... 42/70.11
See application file for complete search history.

(56) References Cited

U.S. PATENT DOCUMENTS

| | | | | |
|---|---|---|---|---|
| 5,193,031 | A * | 3/1993 | Baikrich | F41G 1/35 359/724 |
| 5,735,070 | A * | 4/1998 | Vasquez | F41A 9/62 42/1.02 |
| 9,441,896 | B2 * | 9/2016 | Allan | F41A 17/46 |
| 10,107,599 | B2 * | 10/2018 | Norris | F41H 13/0006 |
| 2006/0026884 | A1 * | 2/2006 | Cerovic | F41H 13/0012 42/84 |
| 2007/0019358 | A1 * | 1/2007 | Kroll | F41H 13/0025 361/232 |
| 2013/0180147 | A1 * | 7/2013 | Lupher | F41A 17/46 42/69.01 |
| 2018/0372456 | A1 * | 12/2018 | Norris | F41H 13/0006 |
| 2019/0113308 | A1 * | 4/2019 | Norris | F41G 1/35 |
| 2020/0072584 | A1 * | 3/2020 | Ozanne | F42B 12/66 |
| 2020/0096297 | A1 * | 3/2020 | Norris | F41H 13/0006 |

OTHER PUBLICATIONS

PCT Application No. PCT/US20/33145 Filing date May 15, 2020, Elwood Norris, International Search Report dated Aug. 12, 2020. 16 Pages.

* cited by examiner

*Primary Examiner* — Samir Abdosh
(74) *Attorney, Agent, or Firm* — Jason Jones

(57) ABSTRACT

A system for alerting a user to a state of a weapon includes a safety assembly, operably coupled to the weapon and operable to selectively render the weapon into either a safe mode or a firing mode. A motor is carried by the weapon and is operably coupled to the safety assembly so as to be engaged when the weapon is in the firing mode. The motor is operable to impart vibratory motion to the weapon of sufficient magnitude that a wielder of the weapon can tactilely sense the vibratory motion without visually inspecting the weapon to thereby sense that the weapon is in the firing mode without visually inspecting the weapon.

12 Claims, 4 Drawing Sheets

SYSTEMS AND METHODS FOR PROVIDING INFORMATION TO USERS OF HAND-HELD WEAPONRY

PRIORITY CLAIM

Priority is claimed of and to U.S. Provisional Patent Application Ser. No. 62/848,813, filed May 16, 2019, which is hereby incorporated herein by reference in its entirety.

BACKGROUND OF THE INVENTION

Field of the Technology

The present technology relates generally to systems for providing information to users of hand-held weaponry. More particularly, the present technology relates to providing such information in a passive manner.

Related Art

Hand-held weapons are often provided with various auxiliary functionality in addition to the functionality necessary to fire the weapon. For example, so-called "safety" mechanisms are often provided that prevent the weapon from being discharged while the safety is engaged. Such mechanisms are often engaged and disengaged via a moveable lever or switch that the user can manipulate with his or her fingers or thumb. In addition, optical sights, such as laser sights, are often provided with weapons to aid the user in sighting the weapon. Most such sighting mechanisms must be activated by a user, either manually or quasi-automatically when the user grasps the weapon.

Conventional auxiliary functionality has frequently been provided with some visual indication of state of activation. For example, safety switches often display a red indicator when the weapon is enabled for firing. While such indicators are useful, they often require the user to visually check the status of the weapon—that is, the user must direct his or her line of vision toward the weapon. For law enforcement, military and other security personnel, brandishing a weapon during a conflict is often very stressful and time-critical: even small amounts of time spent doing anything other than dealing with the situation at hand can have significant consequences. Having to visually verify auxiliary functionality of a weapon can be too time consuming in such situations.

SUMMARY OF THE INVENTION

In accordance with one aspect of the invention, a system is provided for alerting a user to a state of a weapon. The system can include a weapon and a safety assembly, operably coupled to the weapon. The safety assembly can be operable to selectively render the weapon into either a safe mode or a firing mode. A motor can be carried by the weapon, the motor being operably coupled to the safety assembly so as to be engaged when the weapon is in the firing mode. The motor can be operable to impart vibratory motion to the weapon of sufficient magnitude that a wielder of the weapon can tactilely sense the vibratory motion without visually inspecting the weapon to thereby sense that the weapon is in the firing mode without visually inspecting the weapon.

In accordance with another aspect of the technology, a system for alerting a user to a state of a weapon is provided. The system can include a weapon and a safety assembly, operably coupled to the weapon. The safety assembly can be operable to selectively render the weapon into either a safe mode or a firing mode. A light source can be carried by the weapon. The light source can be operable to generate a light beam visible by a wielder of the weapon without visually inspecting the weapon. The light source can be operably coupled to the safety assembly so as to be engaged when the weapon is in the firing mode to enable the wielder of the weapon to sense that the weapon is in the firing mode without visually inspecting the weapon.

In accordance with one aspect of the invention, a method is provided of allowing a user to determine a safety condition of a hand-held weapon without visually inspecting the hand-held weapon. The method can include grasping a hand-held weapon in one or both hands of the user and manipulating a safety assembly operably coupled to the hand-held weapon to thereby render the hand-held weapon into either a safe mode or a firing mode. The hand-held weapon can be positioned out of line-of-sight of the user. A determination can be made, based on either tactile or visual stimulus, of the safety condition of the hand-held weapon without visually inspecting the hand-held weapon.

BRIEF DESCRIPTION OF THE DRAWINGS

The following drawings illustrate exemplary embodiments for carrying out the invention. Like reference numerals refer to like parts in different views or embodiments of the present invention in the drawings.

DETAILED DESCRIPTION

Figure 1:
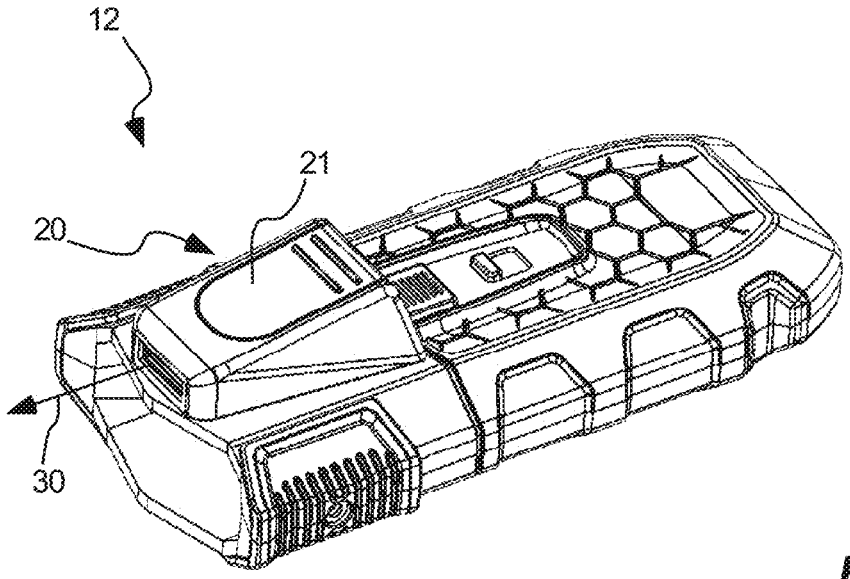
FIG. 1 is a perspective view of an exemplary weapon, in this case a launching device or launcher, in accordance with the present technology having a light beam generator and a motor attached thereto or carried thereby.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

Definitions

As used herein, the singular forms "a" and "the" can include plural referents unless the context clearly dictates otherwise. Thus, for example, reference to "a motor" can include one or more of such motors, if the context dictates. Reference to a motor can also include other mechanical or electrical motion inducing devices to create movement.

As used herein, the term "launcher" refers to any of a variety of devices capable of launching, propelling or otherwise discharging a projectile. Suitable examples of launchers are discussed in related U.S. patent application Ser. No. 15/467,958, filed Mar. 23, 2017, issued as U.S. Pat. No. 10,107,599, which is hereby incorporated herein by reference in its entirety. Other suitable launchers include, without limitation, EMD (electro-muscular discharge) weapons, non-lethal weapons of various types, and the like.

As used herein, the term "substantially" refers to the complete or nearly complete extent or degree of an action, characteristic, property, state, structure, item, or result. As an arbitrary example, an object that is "substantially" enclosed is an article that is either completely enclosed or nearly completely enclosed. The exact allowable degree of deviation from absolute completeness may in some cases depend upon the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result. As another arbitrary example, a composition that is "substantially free of" an ingredient or element may still actually contain such item so long as there is no measurable effect as a result thereof.

As used herein, the term "about" is used to provide flexibility to a numerical range endpoint by providing that a given value may be "a little above" or "a little below" the endpoint.

Relative directional terms can sometimes be used herein to describe and claim various components of the present invention. Such terms include, without limitation, "upward," "downward," "horizontal," "vertical," etc. These terms are generally not intended to be limiting, but are used to most clearly describe and claim the various features of the invention. Where such terms must carry some limitation, they are intended to be limited to usage commonly known and understood by those of ordinary skill in the art in the context of this disclosure.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 to about 5" should be interpreted to include not only the explicitly recited values of about 1 to about 5, but also include individual values and sub-ranges within the indicated range. Thus, included in this numerical range are individual values such as 2, 3, and 4 and sub-ranges such as from 1-3, from 2-4, and from 3-5, etc., as well as 1, 2, 3, 4, and 5, individually.

This same principle applies to ranges reciting only one numerical value as a minimum or a maximum. Furthermore, such an interpretation should apply regardless of the breadth of the range or the characteristics being described.

INVENTION

The present technology relates generally to systems for providing to wielders or users of weapons information about the condition or state of the weapon. Such information can be conveyed to the user via a variety of differing types of alerts. While the type of alert delivered for the user's benefit can vary, in some non-limiting examples the alert can be a visual alert, an audible alert or a tactile alert. The information conveyed by the alert can include, without limitation, whether or not the weapon is in a "safe" mode, wherein activation of a trigger of the weapon will not discharge the weapon, or a "firing" mode wherein activation of the trigger of the weapon can discharge the weapon. Other examples of state or condition information relative to a weapon can include whether the weapon is properly loaded, whether power sources for the weapon or portions of the weapon are properly charged, whether a firing mechanism is properly configured, whether the weapon is oriented correctly or is correctly unholstered, whether a desired targeting objective has been met, etc.

The present technology can do so in a manner that does not require that the wielder of the weapon visually inspect the weapon (e.g., "look at" the weapon): the present technology can provide this information to the user while the user is wielding and/or aiming the weapon in the conventional manner. The present technology can convey any such information in either a positive indication or a negative indication. For example, in embodiments discussed below, the alert provided to a user is a tactile indicator that can positively indicate to the user that the weapon has been removed from safe mode and is ready to discharge. A negative alert can alternatively be generated: for example, a tactile alert may be generated as soon as a user unholsters the weapon and remains on until the weapon has been placed into fire mode. In this case, if the user senses the tactile signal, he or she knows that the weapon is not ready for discharge.

While the present technology can be used in a variety of applications, it is well suited for use with the relatively short-range weapons or launchers shown in the figures. It is to be understood that the present technology is not limited to the specific examples shown, and that is can be readily applied to a variety of known weapon types, including conventional firearms such as handguns, rifles and the like.

Figure 2:
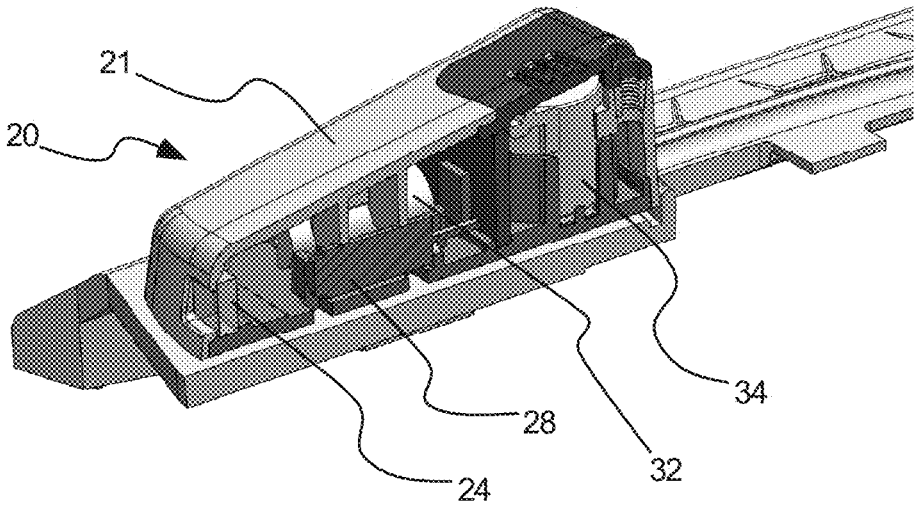
FIG. 2 is a sectioned view of a portion of the launcher of FIG. 1.

One such exemplary device is shown at 12 in FIG. 1 (and partially in FIG. 2). Launchers of the type shown are disclosed in detail in U.S. patent application Ser. No. 15/467,958, filed Mar. 23, 2017, which is hereby incorporated herein by reference in its entirety. The launcher 12 carries a pair of pellets coupled to one another by a tether (neither shown nor discussed in detail herein). The pellets are launched with great force from the launcher 12 toward a subject, which causes the pellets to separate and pull the tether into a taught configuration until contacting the subject. After contact, the tether wraps about the subject, thereby immobilizing the subject. The power source used to launch the tether and pellets from the launcher can vary, but oftentimes generates a sudden release of a wave of pressurized gas.

Figure 3:
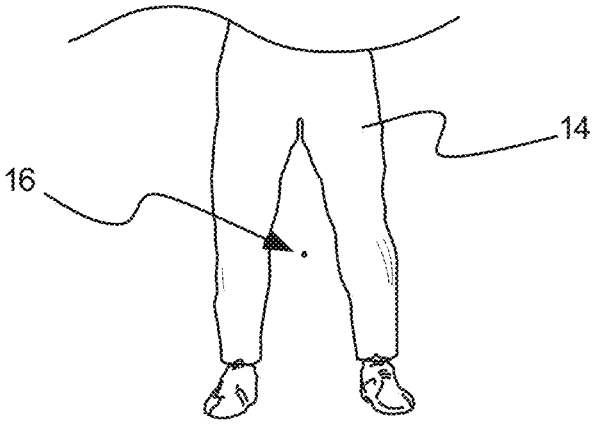
FIG. 3 PRIOR ART
FIG. 3 is a front view of a portion of a subject being targeted by a Prior Art targeting system.
Figure 4:
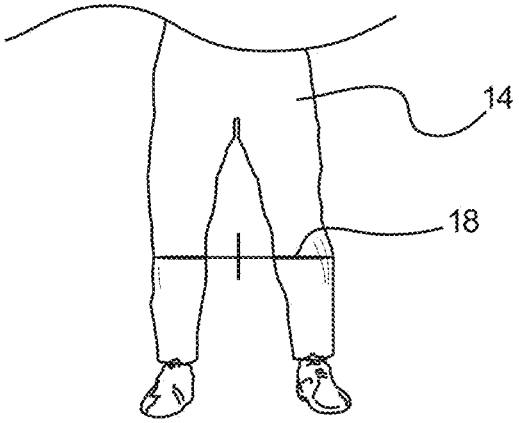
FIG. 4 is a front view of the subject of FIG. 3 being targeted with a light beam generated in accordance with the present technology.

One exemplary manner in which the launcher 12 may be aimed is shown in FIGS. 3 and 4. In the example of FIG. 3, a conventional "point" laser sighting device has been used. While this type of sighting mechanism can be helpful, it is often difficult for a user to properly target a subject with such a laser. The laser output, shown for example at 16, is very small compared to the user, and is often not easy to discern even at the typically short ranges that such a device is used. To exacerbate this problem, the subject 14 is generally moving when the launcher 12 is deployed: as such, the small point of light often resolves behind the subject as it passes through or beside the subject's legs. Further, it is often desired to sight the launcher to a vertical center of the subject—if the launcher is directed toward the subject's legs, the legs may be splayed relative to one another, in which case the conventional laser would resolve on a surface behind the subject, rendering it ineffective.

For at least these reasons, some embodiments of the present technology provide a manner by which a targeting beam pattern can be generated. In this case, a beam pattern can be generated that is generally wider and more easily visualized than a typical point laser sight generating a dot. This beam is much more effective when used with devices such as the launcher 12 shown. FIG. 4 illustrates this targeting beam pattern 18 directed toward user 14. Note that the beam can be much more accurately positioned on the user's legs than conventional point aiming systems. Despite the areas where the beam is not as easily visible (e.g., the area between the user's legs) the beam can still be easily seen and positioned on the legs of the subject. Even in the event the subject's legs are moving, the beam remains visible by the human eye. The beam can also be much more easily centered relative to the subject's vertical centerline, as an end of the targeting beam can be positioned on each of the subject's legs.

In addition, the beam can be aligned with a desired horizontal orientation of the launcher with which it is associated. The beam can then impart information to the user as to the orientation of the launcher, and the user can adjust the position of the launcher accordingly to ensure the launcher is properly oriented (both position-wise and orientation-wise). For example, the beam generating system can be aligned with the launcher such that when the launcher is properly oriented for use, the beam is true to horizontal. Thus, a user can determine proper orientation of the launcher by visualizing only the generated beam. This cannot be accomplished with conventional, point lasers.

Figure 5:
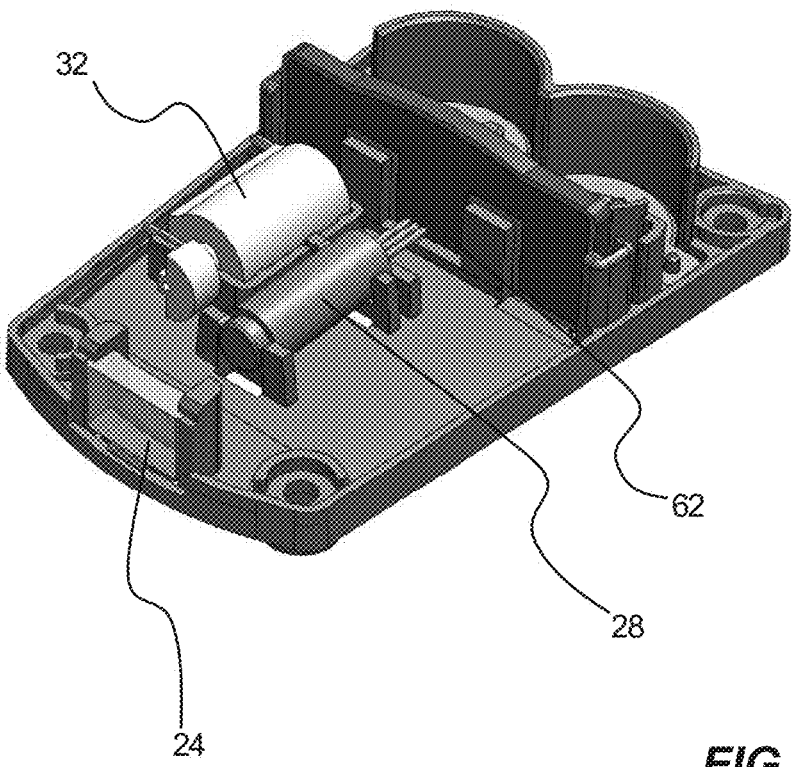
FIG. 5 is a perspective view of a portion of the launcher of FIG. 1.

The present technology can generate this beam using components that can be incorporated into a very small package size, adding very little to the overall size of such devices. In one aspect of the invention, a light source 28 (FIGS. 2 and 5) can be included within an alert generating system 20 that can be attached as shown atop (or beneath) such devices or incorporated into the device. As the system uses very little power, it can be powered with a power source (not shown) already provided with the launcher 12, or a very low-cost and lightweight lithium battery power source (shown by example at 34 in FIGS. 2 and 6)) can easily be incorporated into the alert generating system 20 or the launcher 12. Batteries as small as "½ AA" lithium batteries can provide sufficient output for the device. In some embodiments, the system can be powered by two "⅓ N" batteries, run in parallel. These can provide 45-50 minutes of continuous operation. As the device is rarely used continuously, this power supply can provide ample power for many weeks of service.

In one embodiment, activation of the system 20 can be associated with a function of the launcher 12. For example, in many cases the launcher will have a "safety" setting that, if engaged, disables the launcher from firing. When the launcher is switched into a non-safe condition (e.g., a ready-to-fire condition), the alert generating system 20 can be automatically activated. In this manner, an operator need not independently power up various components of the alert generating system prior to using the launcher. The safety function is discussed in more detail below in connection with external switch 54. This feature of the technology can also allow the alert generating system to provide information to the user or wielder of the weapon as to the "safe" condition of the weapon, without requiring that the user visually verify the status of the weapon.

The exemplary alert and/or beam generating system 20 can include the light source 28. The light source in the examples shown can serve a dual purpose: it can both serve as a visual alert to the user, and it can be used to generate a targeting beam to aid the user in aiming the weapon. The light source can be any of a variety of types of light sources, but in one example is a commercially available green laser. The light source can be operable to generate a laser light beam, shown representatively at reference 30 in FIG. 1. A dispersing or refracting lens 24 (FIGS. 2 and 5) can be carried by the system and positioned in a manner such that the light beam generated by the light source passes through the lens. As the light source exits the lens, the lens can disperse the light into a pattern similar to that shown at 18 in FIG. 4. By properly aligning this pattern on the subject, a user can easily target the subject.

The alert generating system 20 can also include a motor 32 (FIGS. 2 and 5) that can be operable to create vibratory or oscillatory motion. As the motor operates, the vibrations generated by the motor travel through the remaining components of the weapon and into the wielder's hand. In this manner, the wielder can tactilely feel whether or not the motor is operating. In one aspect of the invention, control circuitry, shown generically at 62 in FIG. 5, can be incorporated into the system such that if the light source 28 is activated, the motor is also activated. If the light source is not activated, the motor is similarly inactive. In this embodiment, both the light source and the vibratory motor provide to a user information about whether or not the weapon is ready to fire or is in safe mode. In the first case, a visual alert is provided. In the latter case, a tactile alert is also provided. In other embodiments, only one of a visual alert or a tactile alert may be provided.

While the motor 32 can take a variety of forms, in one embodiment it comprises a micro motor. The motor can be or can include a vibration motor. Vibration motors are known drivers that often are of two basic types: eccentric rotating mass vibration (ERM) motors and linear resonant actuator (LRA) motors. ERM motors use a small unbalanced mass on a DC motor shaft that, upon rotation, creates a force imbalance that translates to a vibratory motion. LRA motors contain a small internal mass attached to a spring, which creates an unbalanced force when driven. In the examples shown, an ERM motor is used that is coupled (directly or indirectly) to the weapon or launcher such that vibratory energy generated by the motor travels through the weapon. While the type of LRA motor can vary, in one aspect the LRA motor exhibits a vibration amplitude of 0.75 g and draws approximately 60 mA when 3 V is applied. The overall size of the motor can be 10 mm or less in diameter and 2 mm or less in height.

Regardless of the specific relationship between the light source 28 and the motor 32, the present technology can be easily tuned to generate a number of desirable outputs. In one exemplary embodiment, the system runs on a power source of only about 3.6 volts DC and weighs less than about 18 grams. In one example, the motor is a 3-5 volt micromotor powered with about 1 volt. The entire system can be provided in a package size less than about 1"×1.25"×0.375". In one embodiment, the laser can be a 5 mw type and the motor can be a 1.5v to 3.6 volt type. The lens 24 can include structure that focuses, channels and/or disperses the laser beam to generate a targeting pattern.

Figure 7:
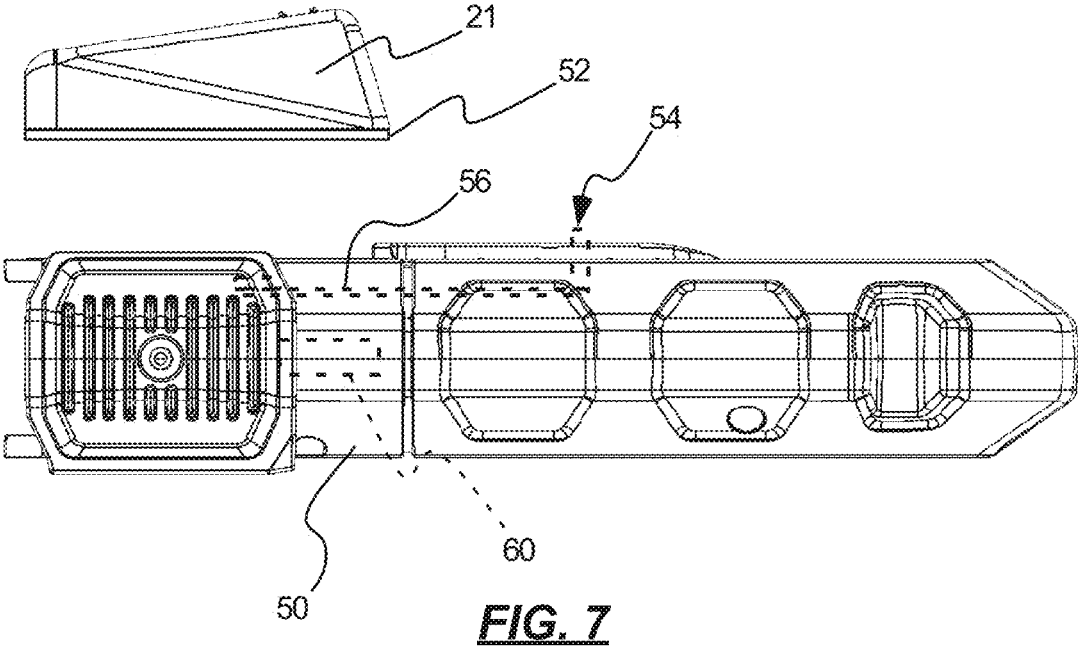
FIG. 7 is a side, partially exploded view of a launcher carrying an alert generating system in accordance with the present technology.

This small size can be packaged in a housing 21 (FIGS. 1, 2 and 7) that can be small enough to enable attachment of the beam generating system on a launcher without negatively impacting other operable components of the launcher. FIG. 7 illustrates the housing 21 removed from a casing 50 of the launcher. In this case, the housing can be attached atop the launcher in a position that does not interfere with other operable components of the launcher, and also provides a clear path for the light beam 30. The beam generating components can also be integrated within the launcher body whereupon a separate housing may not be not required.

While not shown in explicit detail, the control circuitry 62 can include a variety of circuits, components, etc., operable to effectuate the operational aspects of the technology. The circuitry can include, for example, one or more power sources, one or more sensors, controllers, feedback mechanisms, microchips, microcontrollers, etc., as would be apparent to one of ordinary skill in the art having possession of this disclosure. Each of these various components can be operationally coupled to the various motors, light sources, actuators, safety mechanisms, etc., to provide the functionality discussed herein.

In one aspect of the technology, the alert generating system 20 can also provide information relating to the charge of the power source 34. For purposes of this discussion, a new battery or batteries will be assumed to provide about 2.4-2.6 V when the module is powered on. In one aspect, when a power level of the battery is reduced to below about 2.2 V, the control system can slowly reduce output power to prolong battery life. The maximum reduction can be around 40% of available power. In addition, when the power level of the battery is reduced to a lower level, around 2.0 V for example, the laser or light source 28 can initiate a blinking protocol (while still at reduced power, where applicable), but the motor 32 can remain functional. This can alert a user to reduced capacity of the power source.

In some aspects of the technology, when a power level of the battery reduces to below about 1.9 V, the laser or light source 28 can be powered off entirely, but the motor can remain functional. In some embodiments, once the module enters either the flashing or laser-off mode, the control system can prevent reverting to normal mode until the module is powered off and on again. When a power lever of the battery is reduced to below about 1.8 V, the control system can power down the entire unit.

In the example shown in the figures, the vibration motor 32 can be completely independent of the light source 28. That is, operation of the light source need not require nor benefit from operation of the motor, and vice versa. The two can be separate and individually functional components that can be installed in different locations within the launcher and need not be operationally coupled one to another.

Also shown in FIG. 7 is a shock isolation material 52 that can be coupled beneath the housing containing the alert and/or beam generating components. The shock isolation material can be beneficial in protecting the relatively delicate components of the alert generating system from sudden shocks generated by the launcher. In many cases the launcher includes a charge or power source (shown schematically at 60 in FIGS. 6 and 7) used to launch or propel a projectile from the launcher. In some cases, this power source is ballistic charge utilizing gunpowder or the like. In other cases, compressed gasses can be suddenly released to create a pressure wave to propel the projectile. In some launchers, mechanical springs can be utilized.

Whichever propellant system is utilized in the launcher 12, it very often generates a sudden and powerful shock wave. As the alert and/or beam generating system can include delicate components, this shock wave can damage or imbalance the components within the housing 21, rendering them less effective for later usage. The shock isolation material 52 can insulate the alert generating components from the shock generated by the power source. The shock isolation material can take a variety of forms. In one example, the material is an adhesive tape sold under the tradename Gecko Grip. The shock isolation layer can be formed as flexible, adhesive layer having properties similar to foam. When subject to a shock or impact, the foam absorbs energy and limits transmission of vibrations through the casing 50 of the launcher. By utilizing a foam-like adhesive layer, the isolation material can serve to both attach the beam generating components to the launcher, and to isolate the beam generating components from vibratory forces generated by the launcher.

Figure 6:
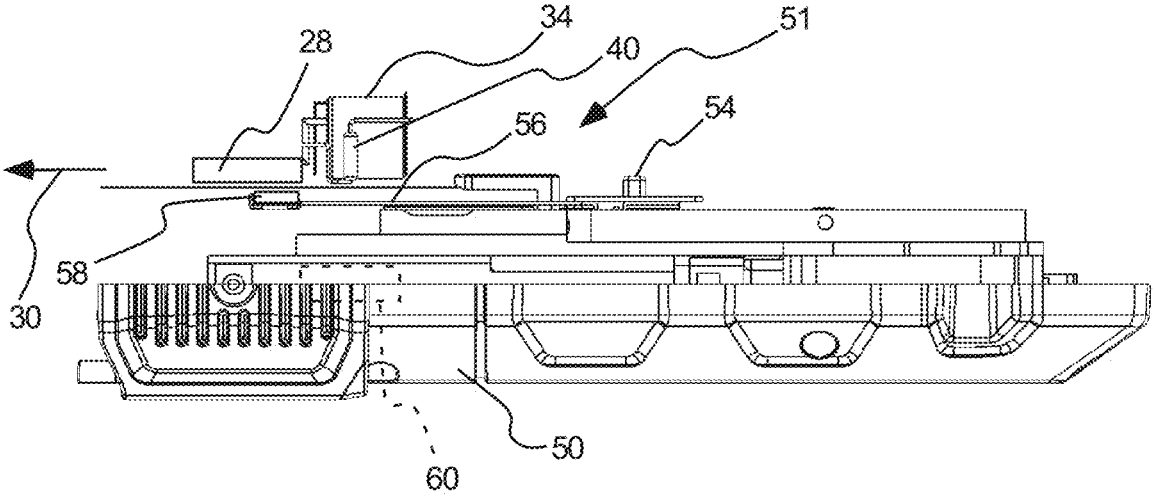
FIG. 6 is a side, partially sectioned view of a launcher having a safety mechanism and carrying an alert generating system in accordance with the present technology.

FIG. 6 illustrates a further embodiment of the invention in which a switching assembly, shown generally at 51, is provided to enable an operator to activate the beam generating system. The system can include a switch 54 that can, in some embodiments, be operable to disengage the safety setting of the launcher. An extension 56 can be coupled to the switch and can extend forwardly from the switch. A magnetic material 58 can be carried by the extension. In the embodiment shown, the magnetic material comprises a small disk magnet. Movement of the switch 54 forwardly and rearwardly can result in a corresponding forward and rearward movement of the magnetic material.

In one embodiment the beam generating system can include a reed switch 40. The reed switch can be activated when subject to a magnetic field. In the position shown in FIG. 6, the magnetic disk 58 is displaced from the reed switch 40. In this position, the safety mechanism of the launcher is also engaged. As the switch 54 is moved rearward relative to the launcher body or casing 50 (rightward in FIGS. 6 and 7), the magnetic disk is positioned beneath the reed switch 40. This results in activation of the beam generating system and also results in placing the launcher in condition to fire (e.g., the safety has been disabled).

In this manner, the alert and/or beam generating system can be activated without a physical connection required between the launcher and the alert generating system. In one aspect of the invention, the reed switch and the magnetic disk are separated by a space of some dimension. In the embodiment shown in FIGS. 6 and 7, this space is at least partially filled by a wall thickness of the casing 50. This casing 50 can be formed from a polymer, or similar material that does not interfere with the magnetic field generated by the disk. In this manner, the launcher 12 (which includes the switch 54, the extension 56 and the magnetic disk 58) and the beam generating system are completely separable one from another. As shown in FIG. 7, the casing 21 that encapsulates the beam generating system can be independently provided and attached to the launcher casing. This can allow the alert/beam generating assembly to function independently of the launcher, without requiring a rigid, physical contact between the switching mechanisms of the two.

In the case where the hand-weapon comprises a launcher suitable to launch a projectile including a pair of pellets and a tether, as outlined in the above-referenced patent to the present inventor, the hand-held weapon is normally held near the user's waist level. This is done in an effort to launch the projectile in as close as possible to a generally horizontal path toward the subject's knees or legs. Thus, in these embodiments, the aspect of providing to the user an indication of a condition of the safety mode of the launcher is beneficial, as the user generally cannot see both the launcher and the subject when firing the launcher. That is, the launcher is out of line-of-sight of the wielder.

In addition to the structure described above, the present technology also provides various methods of providing information to a user or wielder of a weapon relating to various states or conditions of the weapon. Information can be provided to the user through visual, tactile or audible signals. The present technology also encompasses various manners of configuring and/or manufacturing weapons or alert systems for use in connection with weapons.

It is to be understood that the above-referenced arrangements are illustrative of the application for the principles of the present invention. Numerous modifications and alternative arrangements can be devised without departing from the spirit and scope of the present invention while the present invention has been shown in the drawings and described above in connection with the exemplary embodiments(s) of the invention. It will be apparent to those of ordinary skill in the art that numerous modifications can be made without departing from the principles and concepts of the invention as set forth in the examples.

I claim:

1. A system for alerting a user to a state of a hand-held weapon, the system comprising:

a weapon;

a safety assembly, operably coupled to the weapon, the safety assembly operable to selectively render the weapon into either a safe mode or a firing mode;

a motor carried by the weapon, the motor being operably coupled to the safety assembly so as to be engaged when the weapon is in the firing mode;

the motor operable to impart vibratory motion to the weapon of sufficient magnitude that a wielder of the weapon can tactilely sense the vibratory motion to thereby sense that the weapon is in the firing mode without visually inspecting the weapon;

a laser light source carried by the weapon, the laser light source operable to generate a laser light beam visible by a wielder of the weapon without visually inspecting the weapon, the laser light source being operably coupled to the safety assembly so as to be engaged when the weapon is in the firing mode to enable the wielder of the weapon to sense that the weapon is in the firing mode without visually inspecting the weapon; and the laser light source including a dispersing lens, operable to disperse the laser light beam into a targeting pattern.

2. The system of claim 1, wherein the motor comprises a vibration motor.

3. The system of claim 2, wherein the vibration motor comprises an eccentric mass vibration ("ERM") motor or a linear resonant actuator ("LRA") motor.

4. A system for alerting a user to a state of a hand-held weapon, the system comprising:

a weapon;

a safety assembly, operably coupled to the weapon, the safety assembly operable to selectively render the weapon into either a safe mode or a firing mode;

a laser light source carried by the weapon, the laser light source being operable to generate a laser light beam visible by a wielder of the weapon without visually inspecting the weapon;

the laser light source being operably coupled to the safety assembly so as to be engaged when the weapon is in the firing mode to enable the wielder of the weapon to sense that the weapon is in the firing mode without visually inspecting the weapon; and the laser light source including a dispersing lens, operable to disperse the laser light beam into a targeting pattern.

5. The system of claim 4, wherein the laser light source is visible by a wielder of the weapon as the wielder targets a subject with the weapon.

6. The system of claim 4, further comprising a motor carried by the weapon, the motor being operably coupled to the safety assembly so as to be engaged when the weapon is in the firing mode;

the motor operable to impart vibratory motion to the weapon of sufficient magnitude that a wielder of the weapon can tactilely sense the vibratory motion without visually inspecting the weapon to thereby sense that the weapon is in the firing mode without visually inspecting the weapon.

7. The system of claim 6, wherein the motor comprises a vibration motor.

8. The system of claim 7, wherein the vibration motor comprises an eccentric mass vibration ("ERM") motor or a linear resonant actuator ("LRA") motor.

9. A method of allowing a user to determine a safety condition of a hand-held launcher without visually inspecting the hand-held weapon, the method comprising:

grasping a hand-held launcher in one or both hands of the user;

manipulating a safety assembly operably coupled to the hand-held launcher to thereby render the hand-held launcher into either a safe mode or a firing mode;

positioning the hand-held launcher out of line-of-sight of the user; and determining, based on visual stimulus generated by a light source carried by the launcher and operably coupled to the safety assembly of the launcher, the safety condition of the hand-held launcher without visually inspecting the hand-held weapon; wherein the light source comprises a laser light source operable to generate a light beam that resolves on a surface distal from the user and wherein the laser light source includes a dispersing lens, operable to disperse the laser light beam into a targeting pattern that resolves on the surface distal from the user.

10. The method of claim 9, further comprising determining the safety condition of the hand-held launcher without visually inspecting the hand-held weapon based on tactile stimulus generated by a vibration motor carried by the launcher and operably coupled to the safety assembly of the launcher.

11. The method of claim 10, wherein the vibration motor comprises an eccentric mass vibration ("ERM") motor or a linear resonant actuator ("LRA") motor.

12. The method of claim 9, further comprising actuating the launcher to cause a projectile to be expelled therefrom, the projectile including at least a pair of pellets coupled to one another with a tether.

* * * * *